US006170107B1

(12) United States Patent
George et al.

(10) Patent No.: US 6,170,107 B1
(45) Date of Patent: Jan. 9, 2001

(54) ROTATING BRUSH CLEANING APPARATUS

(76) Inventors: Dewey T. George; Loretta A. George, both of P.O. Box 465, Sparr, FL (US) 32192

( * ) Notice: Under 35 U.S.C. 154(b), the term of this patent shall be extended for 0 days.

(21) Appl. No.: 09/086,156

(22) Filed: May 28, 1998

(51) Int. Cl.[7] ..... A46B 13/04

(52) U.S. Cl. ..... 15/24; 15/23; 15/28; 15/29; 15/97.1

(58) Field of Search ..... 15/22.1, 23, 24, 15/28, 29, 97.1, 101

(56) References Cited

U.S. PATENT DOCUMENTS

| | | | | |
|---|---|---|---|---|
| D. 334,287 | | 3/1993 | Ingles | D4/102 |
| D. 335,770 | | 5/1993 | McGregor | D4/102 |
| 1,611,874 | * | 12/1926 | Becker | 15/24 |
| 2,911,660 | * | 11/1959 | Klemas et al. | 15/28 |
| 3,026,552 | * | 3/1962 | Price | 15/97.1 |
| 3,343,192 | * | 9/1967 | Goldstein et al. | 15/23 |
| 3,500,490 | * | 3/1970 | Teren | 15/97.1 |
| 3,570,038 | | 3/1971 | Jones | 15/244.1 |
| 3,822,432 | * | 7/1974 | Skinner | 15/28 X |
| 3,862,461 | | 1/1975 | Bucklitzsch | 15/164 |
| 3,890,984 | * | 6/1975 | Lesetar | 15/23 X |
| 3,892,004 | * | 7/1975 | Downes | 15/24 X |
| 4,060,871 | | 12/1977 | Bryerton | 15/29 |
| 4,137,588 | * | 2/1979 | Sandt et al. | 15/28 X |
| 4,254,526 | * | 3/1981 | Fromm | 15/29 |
| 4,335,481 | * | 6/1982 | Slayman | 15/97.1 X |
| 4,370,771 | | 2/1983 | Gonzalvo | 15/29 |
| 4,502,176 | | 3/1985 | Wallace | 15/164 |
| 4,796,321 | | 1/1989 | Lee | 15/29 |
| 4,799,280 | | 1/1989 | Lee | 15/29 |
| 5,315,729 | | 5/1994 | Yang | 15/75 |
| 5,336,330 | | 8/1994 | Shumway et al. | 134/8 |
| 5,353,461 | * | 10/1994 | Enriquez | 15/97.1 X |
| 5,435,036 | | 7/1995 | Hedrick et al. | 15/59 |
| 5,511,269 | * | 4/1996 | Watson | 15/28 X |
| 5,621,941 | | 4/1997 | Liu | 15/106 |
| 5,701,625 | * | 12/1997 | Siman | 15/97.1 X |

FOREIGN PATENT DOCUMENTS

| | | | | |
|---|---|---|---|---|
| 520468 | * | 1/1956 | (CA) | 15/24 |
| 864159 | * | 2/1971 | (CA) | 15/23 |
| 399415 | * | 3/1966 | (CH) | 15/23 |
| 3516201 | * | 11/1986 | (DE) | 15/23 |
| 1296174 | * | 5/1962 | (FR) | 15/23 |
| 1434908 | * | 3/1966 | (FR) | 15/23 |
| 2080099 | * | 2/1982 | (GB) | 15/23 |
| 641346 | * | 6/1962 | (IT) | 15/24 |

* cited by examiner

*Primary Examiner*—Mark Spisich
(74) *Attorney, Agent, or Firm*—John D. Gugliotta

(57) ABSTRACT

A rotating brush cleaning apparatus is provided having grippable handle and a plurality of elongated brush attachments. The handle houses a rechargeable battery driven motor that drive an attached brush in a circular rotation. Each brush attachment is mounted on a central, elongated bendable plastic core. A first narrow brush attachment is relatively narrow and adapted to be used for cleaning baby bottles and tall glasses. A narrow brush scrubber attachment comprises and annular ring of rough scouring material that can be placed over the narrow brush attachment for cleaning any caked-on residue at the bottom of a baby bottle or tall glass.

9 Claims, 3 Drawing Sheets

ROTATING BRUSH CLEANING APPARATUS

BACKGROUND OF THE INVENTION

1. Field of the Invention

The present invention relates generally to kitchen type cleaning brushes and, more particularly, to a portable, electric, rotating brush cleaning apparatus.

2. Description of the Related Art

As is well-known in the art, many devices and tools exist for assisting in the cleaning of dishes, cookware, pots, pans, baby bottles, and the like. Arising from the inherent problems and inadequacies associated with a common sponge or washcloth, these devices have been developed to solve a variety of particular problems associated with the cleaning of objects have complex, intricate shapes.

A search of the prior art did not disclose any patents that read directly on the claims of the instant invention; however, the following references were considered related:

| U.S. Pat. No. | Inventor | Issue Date |
|---|---|---|
| 5,621,941 | Chih C. Liu | Apr. 22, 1997 |
| 5,435,036 | Bryan E. Hederick, et al. | Jul. 25, 1995 |
| 5,336,330 | Craig S. Shumway, et al. | Aug. 9, 1994 |
| 5,315,729 | Jack Yang | May 31, 1994 |
| 4,799,280 | Fu-Kuei Lee | Jan. 24, 1989 |
| 4,796,321 | Fu-Kuei Lee | Jan. 10, 1989 |
| 4,502,176 | Mark E. Wallace | Mar. 5, 1985 |
| 4,370,771 | Sulpicio A. Gonzalvo | Feb. 1, 1983 |
| 4,060,871 | John B. Bryerton | Dec. 6, 1977 |
| 3,862,461 | Hans H. Bucklitzsch | Jan. 28, 1975 |
| 3,570,038 | V.F. Jones | Mar. 16, 1971 |
| D 335,770 | Dorsie D. McGregor | May 25, 1993 |
| D 334,287 | Dan Ingles | Mar. 30, 1993 |

Generally, such devices as disclosed in the related art either are designed for cleaning of interior cavities that would otherwise be difficult to access, or cleaning of difficult, tenacious dirt that is baked onto the cookware, or both.

While some features are incorporated into this invention in combination, other elements are different enough as to make the combination distinguished over the related art. Consequently, a need has therefore been felt for a portable, electric, rotating brush cleaning apparatus.

SUMMARY OF THE INVENTION

Therefore, it is an object of the invention to indicate a device of the type disclosed above which avoids the disadvantages inherent in the state of the art. In particular, the device is to be lightweight and portable enough to be manipulated with one hand, provide variable speeds and a range of torques for assisting in the cleaning of various levels of residues, be replaceable/washable so as to be cleaned itself after use, and be sufficiently elongated to allow for the cleaning of tight interior cavities, of the size that would be provided with a typical baby bottle.

Briefly described according to one embodiment of the present invention, a rotating brush cleaning apparatus is provided having grippable handle and a plurality of elongated brush attachments. The handle houses a rechargeable battery driven motor that drive an attached brush in a circular rotation. Each brush attachment is mounted on a central, elongated bendable plastic core. A first narrow brush attachment is relatively narrow and adapted to be used for cleaning baby bottles and tall glasses. A narrow brush scrubber attachment comprises an annular ring of rough scouring material that can be placed over the narrow brush attachment for cleaning any caked-on residue at the bottom of a baby bottle or tall glass.

Advantage of the present invention in its sundry alternate forms are numerous. The above listed object being just a few, various alternates of the present invention are envisioned as provided a useful brush cleaning tool from outdoor applications, such as auto wheel mags or barbeque grill cleaning assistance, to a personal hygiene bathroom use version that can allow one to scrub, clean, or exfoliate difficult or hard to reach areas such as behind the back or heels of the feet.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENTS

Figure 1:
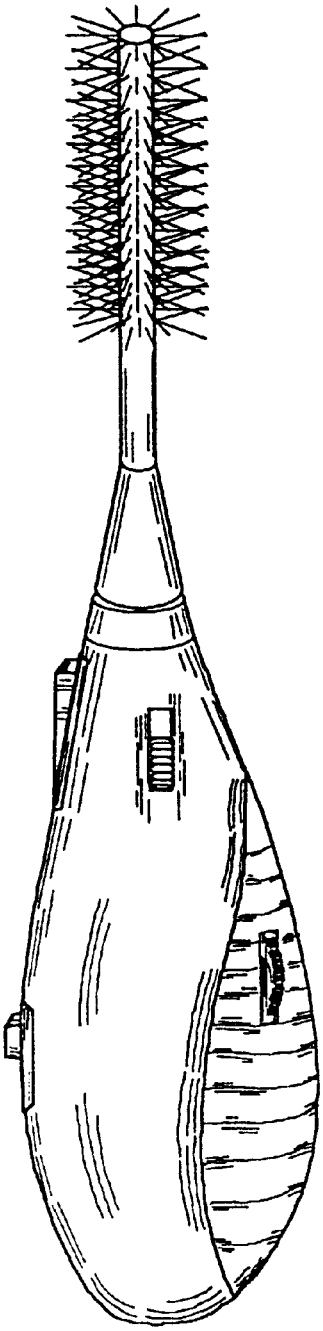
FIG. 1 is a perspective view of a rotating brush cleaning apparatus according to the preferred embodiment of the present invention, shown with a first brush attachment.
Figure 2:
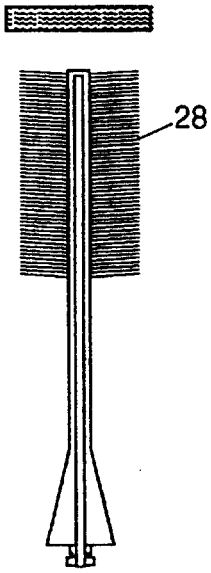
FIG. 2 is a side elevational view of the first brush attachment for use therewith.

Referring now to FIG. 1, a rotating brush cleaning apparatus, generally noted as 10, is shown according to one preferred embodiment of the present invention. In order to provide the powerful, portable scrubbing assistance that is the primary object of the present invention, it is necessary to include a base member 12, shown housing an otherwise conventional direct current driven portable electric motor and electric supply source, such as conventional batteries or rechargeable batteries. In its preferred embodiment, the base member 12 will have an upper attachment end and a lower grasping end formed into a generally elongated, bulbous shaped to provide an easy to grasp and hold shape. This is necessary to provide increased grasping ability due to the intended use envisioned as being in wet, soapy applications. Further, a gripping surface 14 located along at least one side of the base member 12 will improve graspability of the apparatus.

Control surfaces for controlling the internal electric motor are supplied accessible on the surface of the base member. An on/off motor control 16 is provided to engage the rotation of the electric motor. Alternately, should a variable speed motor be utilized, a motor speed control 18 is provided, and located on the base member at a location within easy access of a user's thumb when the base member is grasped by the hand in a normal manner.

The base member supports and engages with a plurality of elongated brush attachments at the upper attachment end.

The rechargeable battery driven motor thereby drives an attached brush in a circular rotation. It is envisioned that a plurality of such brush attachment is to be provided and are to be interchangeable with each other at the attachment end.

As shown in FIGS. 1–5, each brush attachment is mounted on a central, hollow, elongated bendable plastic core 20. The plastic core 20 is hollow and forms a soap distribution conduit 22 through which soap can be dispensed through a plurality of radially aligned soap dispensing orifices 24 about the shaft of the brush. The lower portions of each core 20 forms a connection and drive mechanism 26 that allows each brush to interchangeably be affixed to the drive end of the base 10 and be rotated by the electric motor. Shown in FIGS. 1–2, first narrow brush attachment has bristles 28 that extend about the core 20 in a manner that is relatively narrow and adapted to be used for cleaning baby bottles and tall glasses. In this configuration, a narrow brush scrubber attachment 40 comprising and annular ring of rough scouring pad material that can be placed over the narrow brush attachment for cleaning any caked-on residue at the bottom of a baby bottle or tall glass.

Figure 3:
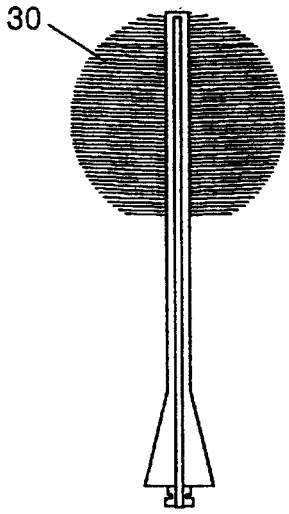
FIG. 3 is a front elevational view of a second brush attachment for use therewith.

As shown in FIG. 3, a second brush attachment is shown. For symmetry of function and interchangeability of components, it is envisioned that the second brush attachment will comprise a plastic core, a soap distribution conduit, radially aligned soap dispensing orifices, and a connection and drive mechanisms in a like manner. The unique features of the second brush attachment include a series of radially aligned bristles 30 that extend about the core 20 such that the bristles 30 that are toward the middle of the brush are longer than those at the upper end or lower end of the brush. By providing a series of symmetrically progressing increasing and decreasing bristle lengths, a brush of an overall general spherical shape as shown in FIG. 3. In this configuration, the present invention becomes particularly well adapted for cleaning the interior cavity of widened drinking containers, such as goblets, snifters, tumblers, glasses, and other conventionally available drinking containers of a similar configuration.

Figure 4:
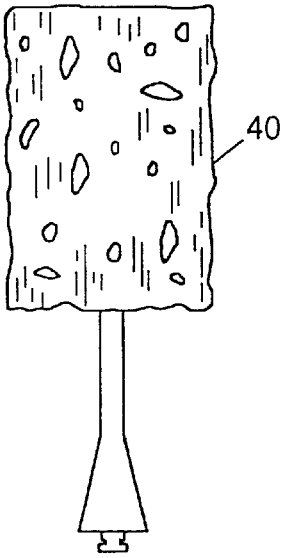
FIG. 4 is an elevational view of an alternate third brush attachment for use therewith.

As shown in FIG. 4, a third brush attachment is shown. For symmetry of function and interchangeability of components, it is envisioned that the third brush attachment will comprise a plastic core, a soap distribution conduit, radially aligned soap dispensing orifices, and a connection and drive mechanisms in a like manner. The unique features of the third brush attachment include the replacing of the bristles with a solid cylindrical tube of sponge 41 attached to the plastic core. In this configuration, the brush attachment can be used to apply soap to, clean, and scrub larger surfaces and containers.

Figure 5:
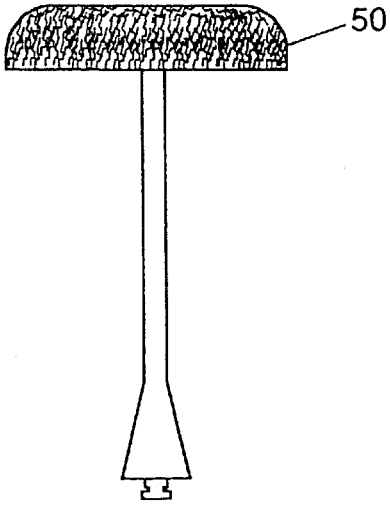
FIG. 5 is an elevational view of an alternate fourth brush attachment for use therewith.

As shown in FIG. 5, a fourth brush attachment is shown. For symmetry of function and interchangeability of components, it is envisioned that the fourth brush attachment will comprise a plastic core, a soap distribution conduit, radially aligned soap dispensing orifices, and a connection and drive mechanisms in a like manner. The unique features of the fourth brush attachment include a flatted, mushroom shaped scouring pad 50 affixed to the uppermost end of the plastic core 20. In such a configuration, the present invention is particularly well suited for cleaning any caked-on residue at the bottom large flat cookware, such as pots or pans.

Figure 6:
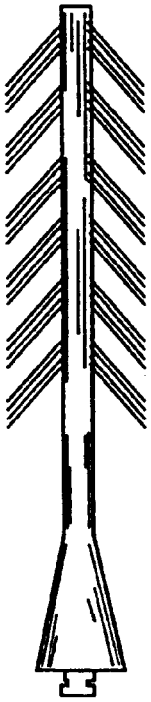
FIG. 6 is an elevational view of an alternate fifth brush attachment.

Alternate brush attachments are also envisioned for use with the present invention that allow for use of the present invention in applications outside use in the kitchen. The above listed object being just a few, various alternates of the present invention are envisioned as provided a useful brush cleaning tool from outdoor applications, such as auto wheel mags or barbeque grill cleaning assistance, to a personal hygiene bathroom use version that can allow one to scrub, clean, or exfoliate difficult or hard to reach areas such as behind the back or heels of the feet. In FIG. 6, a fifth brush attachment is depicted for use in outdoor applications. For symmetry of function and interchangeability of components, it is envisioned that the fifth brush attachment will comprise a plastic core, a soap distribution conduit, radially aligned soap dispensing orifices, and a connection and drive mechanisms in a like manner. The unique features of the fifth brush attachment include the use of rigid bristles 60 that are affixed about the core 20 at an acute angle to the lateral centerline of the core. Although the actual stiffness of the bristles is an obvious design choice that can vary with differing applications, it is envisioned that due to the nature of outdoor use a more rigid bristle would be employed in this application.

Figure 7:
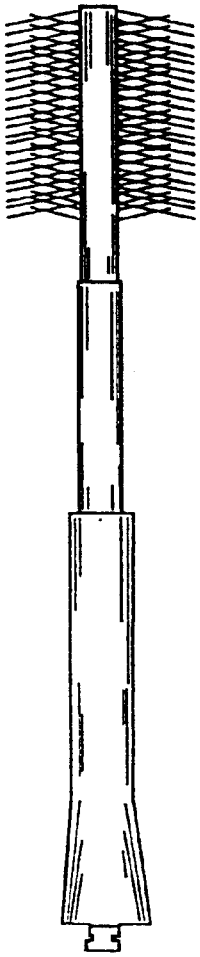
FIG. 7 is an elevational view of an alternate sixth brush attachment.

Finally, in FIG. 7, a sixth brush attachment is disclosed depicting a personal hygiene bathroom use version that can allow one to scrub, clean, or exfoliate difficult or hard to reach areas such as behind the back or heels of the feet. For symmetry of function and interchangeability of components, it is envisioned that the sixth brush attachment will comprise a plastic core, a soap distribution conduit, radially aligned soap dispensing orifices, and a connection and drive mechanisms in a like manner. The unique features of the sixth brush attachment include the use of telescoping core 70 that allows a brush head of any design to be employed in an extended position, thereby allowing the device to be employed in an extended condition, resulting in easier access to a users back or feet without the need to bend or stretch extensively.

The foregoing description is included to illustrate the operation of the preferred embodiment and is not meant to limit the scope of the invention. The scope of the invention is to be limited only by the following claims.

What is claimed is:

1. A rotating brush cleaning apparatus comprising:

a rechargeable battery driven electric motor for driving a brush attachment in a circular rotation, a plurality of brush attachments each including a central, hollow, elongated, bendable plastic core with each brush attachment being adapted to be selectively rotated by said motor, said plastic core being hollow and forms a soap distribution conduit through which soap can be dispensed through a plurality of radially aligned soap dispensing orifices about the core, and wherein the lower portions of each core forms a connection and drive mechanism; one of said brush attachments further comprising a telescoping core that allows a brush head thereon to be employed in an extended position, thereby allowing the brush attachment to be employed in an extended condition, resulting in easier access to remote locations;

a base member housing said rechargeable battery driven motor, said base member having an upper attachment end and a lower grasping end formed into a generally elongated, bulbous shape to provide an easy to grasp and hold shape the connection and drive mechanism of each brush attachment being adapted to be interchangeably affixed to the upper attachment end of the base member;

a gripping surface located along at least one side of the base member;

control surfaces for controlling the internal electric motor accessible on the surface of the base member;

wherein said base member supports and engages a selected one of said plurality of brush attachments at the upper attachment end thereof.

2. The rotating brush cleaning apparatus of claim 1, wherein said control surfaces include an on/off motor control for engaging the rotation of the electric motor.

3. The rotating brush cleaning apparatus of claim 2, wherein said electric motor comprises a variable speed motor, and wherein said control surfaces include a motor speed control.

4. The rotating brush cleaning apparatus of claim 1, wherein one of said brush attachments further comprises a narrow brush attachment having bristles that extend about the core in a manner that is relatively narrow and adapted to be used for cleaning baby bottles and tall glasses.

5. The rotating brush cleaning apparatus of claim 4, wherein said narrow brush attachment further includes a narrow brush scrubber attachment comprising an annular ring of rough scouring pad material that can be placed over the narrow brush attachment for cleaning any caked-on residue at the bottom of a baby bottle or tall glass.

6. The rotating brush cleaning apparatus of claim 1, wherein one of said brush attachments further comprises a spherical brush having a series of radially aligned bristles that extend about the core such that the bristles that are toward the middle of the spherical brush are longer than those at the upper end or lower end of the brush, whereby a brush of an overall general spherical shape is provided adapted for cleaning the interior cavity of widened drinking containers, such as goblets, snifters, tumblers, glasses, and other conventionally available drinking containers of a similar configuration.

7. The rotating brush cleaning apparatus of claim 1, wherein one of said brush attachments further comprises a solid cylindrical tube of sponge attached to the plastic core.

8. The rotating brush cleaning apparatus of claim 1, wherein one of said brush attachments further comprises a flatted, mushroom shaped scouring pad affixed to the uppermost end of the plastic core.

9. The rotating brush cleaning apparatus of claim 1, wherein one of said brush attachments further comprises rigid bristles that are affixed about the core at an acute angle to the centerline of the core.

* * * * *